US010570490B2

(12) United States Patent
Nie et al.

(10) Patent No.: US 10,570,490 B2
(45) Date of Patent: Feb. 25, 2020

(54) STRAIN-INDUCED AGE STRENGTHENING IN DILUTE MAGNESIUM ALLOY SHEETS

(71) Applicant: BAOSHAN IRON & STEEL CO., LTD, Shanghai (CN)

(72) Inventors: Jian-Feng Nie, Clayton (AU); Zhuoran Zeng, Clayton (AU); Mingzhe Bian, Clayton (AU); Christopher Huw John Davies, Clayton (AU); Nick Birbilis, Clayton (AU); Shiwei Xu, Shanghai (CN); Pijun Zhang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 164 days.

(21) Appl. No.: 15/565,093

(22) PCT Filed: Apr. 8, 2015

(86) PCT No.: PCT/CN2015/076023

§ 371 (c)(1),
(2) Date: Oct. 6, 2017

(87) PCT Pub. No.: WO2016/161566

PCT Pub. Date: Oct. 13, 2016

(65) Prior Publication Data

US 2018/0105910 A1 Apr. 19, 2018

(51) Int. Cl.
*C22F 1/06* (2006.01)
*C22C 23/04* (2006.01)

(52) U.S. Cl.
CPC ..... *C22F 1/06* (2013.01); *C22C 23/04* (2013.01)

(58) Field of Classification Search
CPC . C22F 1/06; C22C 23/00; C22C 23/02; C22C 23/04; C22C 23/06
See application file for complete search history.

(56) References Cited

U.S. PATENT DOCUMENTS 3,320,055 A * 5/1967 Foerster ..... C22C 23/00 420/411
2012/0288398 A1* 11/2012 Chen ..... C22F 1/06 420/402

(Continued)

FOREIGN PATENT DOCUMENTS

CN 102978498 A 3/2013
CN 103255329 A 8/2013

(Continued)

OTHER PUBLICATIONS

J.M. Rosalie et al., "Effect of precipitation on strength and ductility in a Mg—Zn—Y alloy" Journal of Alloys and Compounds 550 (2013) (Year: 2013).*

(Continued)

*Primary Examiner* — Anthony J Zimmer
*Assistant Examiner* — Ricardo D Morales
(74) *Attorney, Agent, or Firm* — Knobbe, Martens, Olson & Bear, LLP

(57) ABSTRACT

A method of strengthening a dilute magnesium alloy sheet includes providing a dilute magnesium alloy sheet, which includes a magnesium alloy consisting essentially of (wt %): >0 to 3.0 of Zn; >0 to 1.5 of Ca; 0 to 1.0 of Zr; 0 to 1.3 of a rare earth element or mixture of the same; 0 to 0.3 of Sr; 0 to 0.7 of Al, the balance of Mg and other unavoidable impurities, wherein the total weight % of alloying elements is less than 3%; subjecting the dilute magnesium alloy sheet to plastic deformation, in which the tensile plastic strain should exceed 0.5%, but be less than 8% to form a pre-deformed magnesium alloy sheets; and subjecting the pre-deformed magnesium alloy sheets to an ageing treatment in a temperature range of 80 to 250° C. for at least 1 minute, thereby forming a strengthened magnesium alloy sheet.

22 Claims, 6 Drawing Sheets

(56) References Cited

U.S. PATENT DOCUMENTS

| | | | |
|---|---|---|---|
| 2013/0209195 | A1 | 8/2013 | Kuwabara et al. |
| 2016/0024629 | A1 | 1/2016 | Liang et al. |

FOREIGN PATENT DOCUMENTS

| | | | |
|---|---|---|---|
| CN | 104131204 | A | 11/2014 |
| WO | WO 2009/132436 | A1 | 11/2009 |
| WO | WO 2012/049990 | A1 | 4/2012 |

OTHER PUBLICATIONS

Rokhlin, L. L., and N. I. Nikitina. "Recovery after ageing of Mg—Y and Mg—Gd alloys." Journal of Alloys and Compounds279.2 (1998): 166-170. (Year: 1998).*

International Search Report and Written Opinion dated Jan. 19, 2016 in International Application No. PCT/CN2015/076023, filed Apr. 8, 2015.

J.M. Rosalie et al., "Effect of precipitation on strength and ductility in a Mg—Zn—Y alloy," Journal of Alloys and Compounds 550 (2013) 114-123.

K. Oh-ishi et al., "Age-hardening response of Mg-0.3 at.%Ca alloys with different Zn contents," Materials Science and Engineering A 526 (2009) 177-184.

Mendis, et al., "Understanding precipitation processes in magnesium alloys," Woodhead Publishing Limited (2013), Chapter 4,125-151.

Yu et al., Fabrication of high strength Mg-11Gd-4.5Y-1Nd-1.5Zn-0.5Zr (wt%) alloy by thermomechanical treatments, Materials and Science Engineering A 622 (2015) 121-130.

* cited by examiner

STRAIN-INDUCED AGE STRENGTHENING IN DILUTE MAGNESIUM ALLOY SHEETS

CROSS-REFERENCED TO RELATED APPLICATIONS

This application is a U.S. National Phase Application of PCT International Application No. PCT/CN2015/076023, entitled "STRAIN-INDUCED AGE STRENGTHENING IN DILUTE MAGNESIUM ALLOY SHEETS," filed on Apr. 8, 2015, designating the United States of America and published in the English language as WO 2016/161566 on Oct. 13, 2016.

TECHNICAL FIELD

The present invention generally relates to a method to strengthen dilute magnesium alloy sheets using a strain-induced aging process. The invention is particularly applicable sheets formed from a magnesium alloy containing contain small amounts of zinc and calcium/rare earth elements and it will be convenient to hereinafter disclose the invention in relation to that exemplary application.

BACKGROUND OF THE INVENTION

The following discussion of the background to the invention is intended to facilitate an understanding of the invention. However, it should be appreciated that the discussion is not an acknowledgement or admission that any of the material referred to was published, known or part of the common general knowledge as at the priority date of the application.

Magnesium (Mg) is one of the lightest commercially available structure materials. Mg has a density of 1.74 g/cm$^3$ at 20° C., and this characteristic makes it as a promising candidate for structure applications, such as automotive, aircraft, aerospace, and 3C (computer, communication, and consumer electronic product) industries. However, the room temperature formability of magnesium alloys is generally not high, and this has restricted their large-scale application.

Alloying can improve the ductility and formability of Mg alloys. For example, the applicant's co-pending provisional patent application relates to magnesium-zinc based alloys in which the addition of small amounts of calcium or rare earth metals to magnesium-zinc based alloys improve the ductility and formability of sheets formed from these alloys. Nonetheless, the addition of small amount of alloying elements does not effectively strengthen the resulting alloy sheets. It is therefore desirable to further enhance the strength of sheets formed from this type of magnesium alloy.

The inventors are aware of a number of publications that report that high strength magnesium alloys can be formed using a high concentration of alloying elements, in most cases close to or more than 10 wt %. These alloys often include a large amount of zinc, or one or more rare earth elements such as gadolinium, yttrium, neodymium, and cerium. The inclusion of these alloying elements results in precipitation hardening of the Mg-alloy following an ageing treatment through the generation of a multitude of strengthening precipitates, and thus improvement in the strength of these concentrated Mg alloys. In comparison, magnesium alloys with dilute alloying compositions (<3 wt % total alloying composition) have traditionally not been considered to have a similar age-hardening response. The low alloying composition is thought to not be sufficient to produce the requisite strengthening precipitates. Accordingly, such dilute magnesium alloys and sheets made therefrom are not expected to have any significant age-hardening response.

It would therefore be desirable to provide a method of producing a high strength magnesium alloy sheet formed from a dilute magnesium alloy.

SUMMARY OF THE INVENTION

The present invention relates to a method of strengthening dilute magnesium alloy sheets. It should be appreciated that dilute magnesium alloy sheets are one or more sheets formed from a magnesium alloy which includes less than 3 wt % alloying elements.

The present invention provides a method of strengthening a dilute magnesium alloy sheet comprising:

(A) providing a dilute magnesium alloy sheet comprising a magnesium alloy consisting essentially of (wt %): >0 to 3.0 of Zn; >0 to 1.5 of Ca; 0 to 1.0 of Zr; 0 to 1.3 of a rare earth element or mixture of the same; 0 to 0.3 of Sr; 0 to 0.7 of Al, the balance of Mg and other unavoidable impurities, wherein the total weight % of alloying elements is less than 3%;

(B) subjecting the dilute magnesium alloy sheet to plastic deformation, in which the tensile plastic strain should exceed 0.5%, but be less than 8% to form a pre-deformed magnesium alloy sheets; and (C) subjecting the pre-deformed magnesium alloy sheets to an ageing treatment in a temperature range of 80 to 250° C. for at least 1 minute, thereby forming a strengthened magnesium alloy sheet.

Magnesium alloy sheets formed from an alloy containing contain small amounts of zinc and calcium/rare earth elements have a good ductility though, their strength is generally not high and they could not be age-strengthened effectively. The inventors have found that the strength and more particularly the yield strength of these dilute magnesium alloy sheets could be improved (i.e. increased), in many cases significantly improved, by introducing a small amount of plastic deformation to the formed alloy sheets followed by ageing treatment. The strain-induced age strengthening phenomena of the present invention therefore provides an effective means to strengthen those magnesium alloy sheets that have high ductility and formability, enabling those alloy sheets to have more commercial value.

The increase in strength due to the dual treatment regime of plastic deformation followed by ageing treatment can be measured in % increase or MPa increase. It should be appreciated that the overall yield stress is dependent on more factors than the treatment method, and will be dependent on factors such as sheet formation process, rolling conditions, annealing temperature in that process and other factors affecting the properties and microstructure of that magnesium alloy sheet. Nevertheless, if the above considerations are constant then the strength increase or strengthening of the treatment process of the present invention can be quantified as follows:

$$\text{Strengthening} = \frac{\left(Y.S.\ \text{with plastic deformation and ageing} - Y.S.\ \text{without plastic deformation}\right)}{Y.S.\ \text{without plastic deformation}} \times 100 \quad (1)$$

where Y.S. means yield strength

In some embodiments the strengthening or strength increase of the strengthened magnesium alloy sheet (SMA) relative to the dilute magnesium alloy sheet (i.e. as-annealed after formation) (OMA) (i.e. $100*(YSS_{MA}-YSO_{MA}/YSO_{MA})$ is at least 10%, preferably at least 20%. Preferably, the strength increase of the strengthened magnesium alloy sheet relative to the dilute magnesium alloy sheet is between 20% and 150%, more preferably between 20% and 130%. It should be appreciated that a strength increase of between 20% and 100% and more particularly above 50% is a very unexpected result for a dilute Mg alloy sheet.

In MPa, the strength increase (i.e. Yield Strength of SMA−Yield Strength of OMA) of the strengthened dilute magnesium alloy sheet relative to the dilute magnesium alloy sheet is preferably at least 10 MPa, more preferably at least 20 MPa, yet more preferably at least 33 MPa. In some embodiments, the strength increase of the strengthened magnesium alloy sheet relative to the dilute magnesium alloy sheet is between 33 MPa and 139 MPa, preferably between 35 MPa and 135 MPa.

The strength of the strengthened magnesium alloy sheet is a result of the dual treatment regime of plastic deformation (or pre-deformation) step and ageing treatment step. The parameters and conditions of these steps are preferably controlled to optimise the strength of the resulting strengthened magnesium alloy sheet.

In the present invention, a small amount of plastic strain is used to produce significant improvement in the strength of the dilute magnesium alloy sheet. For example, the tensile plastic strain from plastic deformation should exceed 0.5%, but be less than 8%. In preferred embodiments, tensile plastic strain is controlled in the range of 0.5 to 6%, preferably 0.7 to 5%, more preferably from 1 to 4%.

Furthermore, the ageing treatment should be conducted a temperature range of 80 to 250° C. for at least 1 minute. In preferred embodiments, the temperature range of the ageing treatment is between 100 and 250° C., preferably between 100 and 200° C. Similarly, in some embodiments, the ageing treatment is no more than 24 hours, preferably at most 12 hours. Furthermore, in some embodiments, it is preferred for the ageing treatment to be at least 5 minutes. For example, in some embodiments the ageing treatment is between 5 minutes and 12 hours.

Plastic deformation and ageing treatment steps can be undertaken using any suitable equipment and/or apparatus. In some embodiments, plastic deformation is achieved by at least one of tensile stretching or cold rolling. However, it should be appreciated that other plastic deformation techniques could be used such as bending and forming. Said tensile stretching is preferably conducted at room temperature. Furthermore, where cold rolling is used for this step the reduction in thickness of the magnesium alloy sheet resulting from cold rolling does not exceed 20%, preferably does not exceed 15%, and more preferably does not exceed 10%. Similarly, in some embodiments the ageing treatment is conducted in air or oil, preferably oil bathes. However, it should be appreciated that other apparatus could equally be used to provide the same treatment.

The dilute alloying composition of the magnesium alloy of the dilute magnesium alloy sheet is an important component of the present invention. In the most general compositional makeup, the magnesium alloy consists essentially of (wt %): >0 to 3.0 of Zn; >0 to 1.5 of Ca; 0 to 1.0 of Zr; 0 to 1.3 of a rare earth element or mixture of the same; 0 to 0.3 of Sr; 0 to 0.7 of Al, the balance of Mg and other unavoidable impurities, wherein the total weight % of alloying elements is less than 3%. In some embodiments, the magnesium alloy includes 0.1 to 3.0 wt % Zn, preferably 0.5 to 2.0 wt % Zn. In some embodiments, the magnesium alloy includes 0.05 to 1.5 wt % Ca, preferably 0.1 to 1.0 wt % Ca.

Depending on the alloy composition, an amount of a rare earth element may be present. In the most general form, the magnesium alloy includes (wt %): 0 to 1.3 of a rare earth element or mixture of the same, though in some forms the rare earth element or mixture of the same may comprise between 0.05 wt % and 1.3 wt %. The rare earth element or mixture of the same content of the magnesium alloy (where applicable) may comprise a rare earth element of the lanthanide series or/and yttrium. For the purposes of this specification the lanthanide elements comprise the group of elements with an atomic number including and increasing from 57 (lanthanum) to 71 (lutetium). Such elements are termed lanthanide because the lighter elements in the series are chemically similar to lanthanum. Strictly speaking lanthanum is a group 3 element and the ion $La^{3+}$ has no f electrons. However for the purposes of this specification lanthanum should be understood to be included as one of the rare earth elements of the lanthanide series. Therefore the rare earth elements of the lanthanide series comprise: lanthanum, cerium, praseodymium, neodymium, promethium, samarium, europium, gadolinium, terbium, dysprosium, holmium, erbium, thulium, ytterbium and lutetium. For present purposes, yttrium will also be considered to be encompassed by the term "rare earth element". In some embodiments, the rare earth component comprises gadolinium (Gd). In other embodiments, the rare earth component comprises a mixture of gadolinium (Gd) and lanthanum (La). In other embodiments, the rare earth component comprises a mixture of gadolinium and yttrium. An advantage of an embodiment comprising a rare earth element of the lanthanide series or yttrium is their relatively high solubility in magnesium.

In some embodiments, the magnesium alloy of the magnesium alloy sheet consists essentially of (wt %): Zn: >0 to 3.0; Ca: >0 to 1.5; Zr: 0 to 1.0; Gd: 0 to 1.0, preferably 0.05 to 1.0; Sr: 0 to 0.3; La: 0 to 0.3; Al: 0 to 0.7; and the balance of Mg and other unavoidable impurities, wherein the total weight % of alloying elements is less than 3%.

In preferred embodiments, the magnesium alloy consists essentially of (wt %): Zn: 0.1 to 2.0; Ca: 0.3 to 1.0; Zr: 0.2 to 0.7; Gd: 0.1 to 0.5; Sr: 0 to 0.2; La: 0 to 0.2; Al: 0 to 0.5; and the balance of Mg and other unavoidable impurities, wherein the total weight % of alloying elements is less than 3%.

This invention is applicable for strengthening highly formable magnesium dilute sheet alloys, but it can also be applied to extruded magnesium products made of Mg—(Zn)—RE, Mg—Zn—(RE)-Ca—Zr and Mg—Ca—Zn—(Zr) compositions. Thus, in some embodiments, the specific magnesium alloy used for the magnesium alloy sheet can be divided into three general dilute magnesium based alloy compositions as follows:

Group 1: Mg—(Zn)—RE based alloys;

Group 2: Mg—Zn—(RE)-Ca—(Zr) based alloys; and

Group 3: Mg—Ca—Zn—(Zr) based alloys.

Group 1: Mg—(Zn)—RE System

In the group 1 alloy system, the Mg alloy sheets include zinc which is more than 0% and less than 3.0%, rare earth element or mixture of the same which is greater than 0.05% and less than 1.0%, calcium which is more than 0% and less than 1.0%, strontium which is greater than 0% and not more than 0.3%, and the balance of Mg, and other unavoidable impurities. The rare earth element or mixture of the same can comprise the rare earth elements or mixture of rare earth elements discussed above. However, in preferred embodiments the RE content comprises 0.05% to 1.0% of Gd and greater than 0% to 0.3% lanthanum (La). In some embodiments, the group 1 Mg alloys include more than 0.5% but less than 2.0% of Zn, 0.05% to 1.0% of Gd, 0.05% to 1.0% of Ca, greater than 0% to 0.3% strontium (Sr), greater than 0% to 0.3% lanthanum (La) and the balance of Mg, and other unavoidable impurities.

Group 2: Mg—Zn—(RE)-Ca—(Zr) Based Alloys:

In the group 2 alloy system, Mg alloys include more than 0.5% but less than 2.0% of Zn, 0.05% to 1.0% of Ca, 0% to 1.0% of Gd, 0.1% to 1.0% of Zr, 0% to 0.3% strontium (Sr), 0% to 0.3% lanthanum (La) and the balance of Mg, and other unavoidable impurities. In addition, preferably, the amount of Zn is ranging from 0.5% to 2.0%. Furthermore, the amount of Ca is preferably greater than 0.1% and less than 1.0%. In addition, it is preferable to contain greater than 0.05% and less than 0.7% of Gd. Furthermore, the amount of Zr is preferably greater than 0.2% and less than 0.7%. In addition, the amount of Sr is preferably less than 0.2%. Furthermore, it is preferable that the content of La is less than 0.2%.

Group 3: Mg—Ca—Zn—(Zr) Based Alloys.

In the group 3 alloy system, Mg alloys include greater than 0.5% but less than 1.5% of Ca, 0.1% to 0.8% of Zn, 0% to 1.0% of Gd, 0% to 0.7% of Al, 0% to 0.3% Sr, 0 to 1.0% of Zr, and the balance of Mg, and other unavoidable impurities. In addition, it is preferable that the content of Ca is ranging from 0.6% to 1.0%. Furthermore, the amount of Zn is preferably greater than 0.3% and less than 0.5%. In addition, the amount of Gd is preferably greater than 0.05%, preferably greater than 0.1% and less than 0.5%. Furthermore, the amount of Al is preferably greater than 0.1%, more preferably greater than 0.2% and less than 0.5%. In addition, the amount of Sr is preferably less than 0.2%. Furthermore, the amount of Zr is preferably greater than 0.2% and less than 0.7%.

The present dilute magnesium alloy sheet is a magnesium alloy having a dilute alloying content. Accordingly, the total amount of alloying elements is less than 3%. It should be appreciated that further alloying addition can be harmful to the formability of Mg wrought alloys as it leads to formation of second phase particles that may act as nucleation sites for cracks during deformation.

The dilute magnesium alloy sheet is preferably formed from a magnesium based wrought alloy. In embodiments, the magnesium based alloy is selected from one of: Mg-1Zn-0.4Gd-0.2Ca, Mg-1.3Gd, Mg-1Zn-0.5Ca, Mg-2Zn-0.4Gd-0.2Ca, Mg-2Zn-0.5Ca, Mg-0.8Ca-0.4Zn-0.1Sr-0.5Zr, Mg-0.8Ca-0.4Zn-0.4Gd-0.5Zr, Mg-0.8Ca-0.4Zn-0.1Sr-0.4Gd-0.5Zr, Mg-2Zn-0.5Ca-0.5Zr. In preferred embodiments, the magnesium based alloy is selected from one of: Mg-2Zn-0.5Ca, Mg-2Zn-0.5Ca-0.5Zr or Mg-0.8Ca-0.4Zn-0.1Sr-0.4Gd-0.5Zr.

Manganese (Mn) can be also added to both Zr-free and Zr-containing alloys to minimise the content of iron and to further improve corrosion resistance. If present, the amount Mn is preferably greater than 0.05% and less than 0.7%, more preferably greater than 0.1% and less than 0.5%.

The magnesium-based alloy preferably comprises a minimal amount of incidental impurities. In some embodiments the magnesium-based alloy comprises incidental impurities having less than having less than 0.5% by weight, more preferably less than 0.2% by weight. The incidental impurities may comprise Li, Be, Ca, Sr, Ba, Sc, Ti, Hf, Mn, Fe, Cu, Ag, Ni, Cd, Al, Si, Ge, Sn, and Th, alone, or in combination, in varying amounts.

The dilute magnesium-based alloy sheet used for the strengthening treatment can be produced, manufactured or fabricated using any one of a number of known production methods for magnesium sheet fabrication. In some embodiments, the dilute magnesium-based alloy sheet product is fabricated using the following steps:

providing a magnesium alloy melt from said magnesium-based alloy;

casting said magnesium alloy melt into a slab or a strip according to a predetermined thickness;

homogenising or preheating said cast slab or strip;

successively hot rolling said homogenised or preheated slab or strip at a suitable temperature to reduce said thickness of said homogenised slab or strip to produce an alloy sheet product of a predetermined thickness; and annealing said alloy sheet product at a suitable temperature for a period of time.

The magnesium alloy melt can be produced using any suitable method. In many embodiments, the respective elements were mixed and melted in a furnace, for example a high frequency induction melting furnace, in a suitable receptacle, such as a mild steel crucible to a temperature above the liquidus temperature for that alloy embodiment. In some embodiments, the melt is heated to approximately 760° C. under an argon atmosphere.

The casting step can comprise any suitable casting process. For example, the casting step may involve casting an ingot or billet. In other embodiments, the casting step may involve casting into sheet or strip. In some embodiments, casting comprises pouring the magnesium alloy melt into one of a direct chill (DC) caster, a sand caster, or a permanent mould caster. For example, the casting step may include using a DC cast billet which is subsequently extruded to form a slab or strip after preheating. In other embodiments, the casting step comprises feeding the magnesium alloy melt between rolls of a twin-roll caster to create a strip.

The homogenising or preheating of the cast slab or strip preferably occurs at a temperature of between 300 to 420° C. The actual homogenising temperature is dependent upon alloy composition. In some embodiments, the homogenising or preheating of the cast slab or strip is followed by quenching, preferably water quenching. The homogenising or preheating of the cast slab or strip is preferably carried out for a period of about 0.25 to 24 hours.

The homogenised slab or strip are preferably machined into strips of 5 mm thickness and then hot rolled. Hot rolling is preferably conducted in the temperature range of 300 to 550° C., more preferably 350 to 500° C. Hot rolling typically results in a total thickness reduction of 60 to 95%, preferably 70 to 90%.

In some embodiments, hot rolling is conducted using a plurality of rolling passes, in which after each rolling pass, the sheets were reheated at a temperature in the range of 350 to 500° C. prior to subsequent rolling. The sheets are preferably reheated for about 5 to 20 minutes, preferably 5 to 10 minutes. The thickness reduction per pass is preferably about 20%. Accordingly, the total reduction can be about 80% with the thickness reduction per pass being about 20%.

After the final rolling, the sheets are given a final annealing treatment to remove accumulated strains through static recrystallization. The annealing temperature preferably is ±50° C. from the inflection point of an annealing curve obtained for a composition of the alloy for a standard period of 1 hour. Furthermore, the period of time to anneal said alloy sheet product is preferably approximately 1 minute to 24 hours.

BRIEF DESCRIPTION OF THE DRAWINGS

The present invention will now be described with reference to the figures of the accompanying drawings, which illustrate particular preferred embodiments of the present invention, wherein.

DETAILED DESCRIPTION

The inventors have found that the strength of dilute magnesium alloy sheets formed from an alloy containing contain small amounts of zinc and calcium/rare earth elements can be improved, in some cases significantly improved, by using a strengthening method which introduces a small amount of plastic deformation to the dilute magnesium alloy sheet followed by an ageing treatment. The discovery of the inventive strain-induced age strengthening phenomena provides an effective means to strengthen those magnesium alloy sheets that have high ductility and formability, increasing the commercial value of those alloy sheets.

Whilst not wishing to be limited to any one theory, the inventors consider that strengthening resulting from the treatment method or process of the present invention has a different mechanism of hardening compared to prior aged-hardening mechanisms known for magnesium alloys. In the prior art, it has been found that plastic deformation of Mg alloys with high alloy concentrations such as Mg-5Y-2Nd-2heavy rare earth-0.4Zr, wt. % (WE54) and Mg-11Gd-4.5Y-1Nd-1.5Zn-0.5Zr wt. % results in precipitate hardening resulting from a higher density of precipitates. However, a dilute Mg alloyed sheet (which is the subject of the present invention) is strengthened using a mechanism likely to be the effective pinning of mobile basal dislocation by GP zones and solute atoms.

The present invention is applicable for strengthening highly formable magnesium dilute sheet alloys, but it can also be applied to extruded magnesium products made of Mg—(Zn)—RE, Mg—Zn—(RE)-Ca—(Zr) and Mg—Ca—Zn—(Zr) compositions. The exemplary dilute magnesium based alloys have been found to generally fall into three general alloy systems: Mg—(Zn)—RE system; Mg—Zn—(RE)-Ca—(Zr) system; and Mg—Ca—Zn—(Zr) system. Alloy sheets of the each of these systems can be are subjected to a plastic deformation such as tensile stretching at room temperature or cold rolling in which tensile plastic strain should exceed 0.5%, but less than 8%, and preferably controlled in the range of 1 to 4%, with reductions of cold rolling preferably not to exceed 10%. The pre-deformed magnesium alloy sheets are subsequently given an ageing treatment in the temperature range of 80 to 250° C., with the ageing time preferably not exceeding 24 hours. Strength improvements of the dilute magnesium alloy sheet of between 20 to 129% (33 to 139 MPa) have been demonstrated following application of the method of the present invention, as outlined in the examples below.

Figure 1:
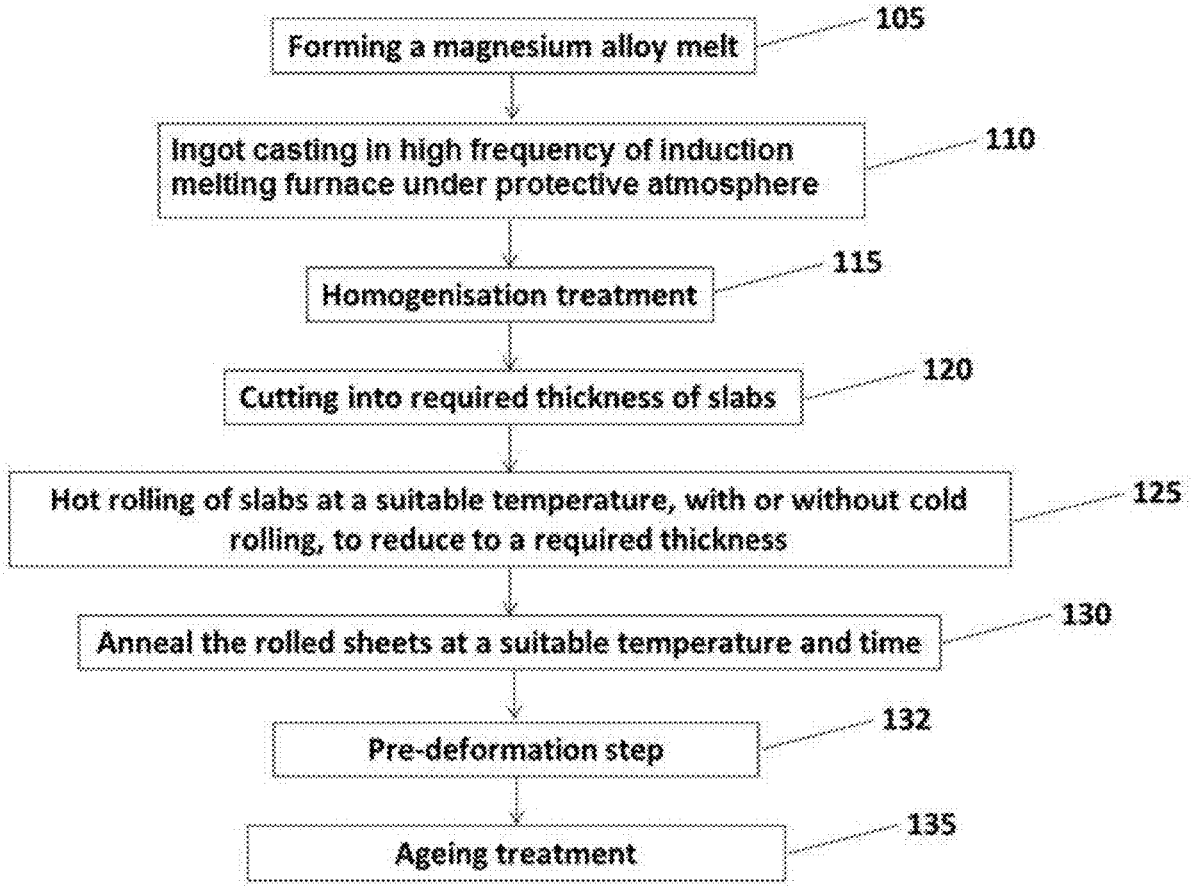
FIG. 1 is a flow chart of depicting a method of fabricating magnesium wrought alloys in accordance with invention including experimental testing regime.

FIG. 1 illustrates a flow chart depicting a method of fabricating a magnesium alloy sheet used in the method of the present invention. As shown in FIG. 1, a dilute magnesium based alloy according to the composition described herein is first provided in the initial step 105.

Following melt preparation, the respective alloys are cast using a suitable casting technique in step 110. In some embodiments, the casting step may involve casting an ingot, billet, bar, block or other moulded body. In other embodiments, the casting step may involve casting into a sheet or strip.

Examples of casting techniques include twin roll casting (TRC), sand casting with or without chill plates on the two faces of the casting or DC casting. It should be appreciated that a number of direct chill (DC) casting methods and apparatus suitable for magnesium alloys are well known in the art and can be used in the process/method of the present invention. The strip or slab could also be made from a DC cast billet which has been subsequently extruded to a slab or strip again using methods and apparatus suitable for magnesium alloys that are well known in the art.

In one embodiment, alloys were melted and cast using a high frequency induction melting furnace using a mild steel crucible at approximately 760° C. under an argon atmosphere. The steel mould was pre-heated to about 200° C. prior to casting. The resulting melt was cast into suitably sized ingots 30 mm thick×55 mm width×120 mm length.

Homogenisation or preheating is employed to reduce the interdendritic segregation and compositional differences associated with the casting process. A suitable commercial practice is to choose a temperature, usually 5 to 10° C., below the non-equilibrium solidus. Given that magnesium, zinc and calcium are the major constituents in the alloys, a temperature range of 300 to 500° C., depending upon alloy composition. The time required for the homogenisation step is dictated by the size of the cast ingot, billet, strip or slab. For TRC strip a time of 2 to 4 hrs is sufficient, while for sand cast slab or direct-chill cast slab up to 24 hrs will be required. The homogenisation treatment is followed by a quenching step, typically a water quenching step.

For experimental purposes, the homogenised ingots are machined into strips of 5 mm thickness. However, it should be appreciated that strips can be formed using any number of other techniques as discussed above in the casting step.

The homogenised ingots, strips or slabs are then hot rolled at a suitable temperature, in step 120. Depending on the cast material different rolling steps may be used. For alloy slabs with a thickness above 25 mm produced by sand casting, DC casting or any other type of casting, a break-down rolling step can be used. The aim of this step is to reduce the thickness, as well as to refine and remove the cast structure. The temperature for this step is dependent on the furnace available at the rolling facility, but usually a temperature between 350 to 500° C. is employed. For alloy strips produced by TRC, rolling is performed at a temperature between 250° C. to 450° C. without the need of a break-down rolling step. Hot rolling involves the strip to pass between the rollers a number of times. After each rolling pass, the sheets are typically reheated at a temperature in the range of 350 to 500° C. for about 5 to 10 minutes prior to subsequent rolling to bring the temperature up before the next pass. A few cold passes with a percentage reduction per pass of 10 or 20% may also be used as a final rolling or sizing operation. This process is continued until the final thickness (within the set tolerances) is achieved, at step 125. The total reduction can be about 85% with the thickness reduction per pass being about 20%. After each rolling pass, the sheets were reheated at a temperature in the range of 350 to 500° C. for about 10 minutes prior to subsequent rolling. In some embodiments, a further cold rolling was adopted as a final rolling.

After the final rolling, with or without the cold rolling step, the sheets were given an annealing treatment at a suitable temperature and time to remove accumulated strains through static recrystallization in step 130. Annealing is a heat treatment process designed to restore the ductility to an alloy that has been severely strain-hardened by rolling. There are three stages to an annealing heat treatment—recovery, re-crystallisation and grain growth. During recovery the physical properties of the alloy like electrical conductivity is restored, while during recrystallisation the cold worked structure is replaced by new set of strain-free grains. Recrystallisation can be recognised by metallographic methods and confirmed by a decrease in hardness or strength and an increase in ductility. Grain growth will occur if the new strain-free grains are heated at a temperature above that required for recrystallisation resulting in significant reduction in strength and should be avoided. Recrystallisation temperature is dependent on the alloy composition, initial grain size and amount of prior deformation among others; hence, it is not a fixed temperature. For practical purposes, it may be defined as the temperature at which a highly strain-hardened (cold worked) alloy recrystallises completely in 1 hour.

The optimum annealing temperature for each alloy and condition is identified by measuring the hardness after exposing the alloy at different temperatures for 1 hr, and establishing an annealing curve to identify the approximate temperature at which recrystallisation ends and grain growth begins. This temperature may also be identified as the inflection point of the hardness-annealing temperature curve. This technique allows achieving the optimum temperature easily and reasonably accurately.

Thereafter, the annealed strips were quenched in a suitable medium, for example water.

The formed magnesium alloy sheet is strengthened using a two-step strengthening process:

Firstly, the formed magnesium alloy sheet is subjected to plastic deformation using a pre-deformation step 132 comprising either tensile stretching at room temperature or a cold rolling process. In each case, the tensile plastic strain applied should exceed 0.5%, but be less than 8%. Where cold rolling is used, the thickness change (decrease) should not exceed 10%. This plastic deformation forms a pre-deformed magnesium alloy sheets.

Secondly, the pre-deformed magnesium alloy sheet or sheets is subject to an ageing treatment 135 in a temperature range of 80 to 250° C. for at least 1 minute. Aging typically occurs in a temperature controlled environment. Suitable environments include a furnace, or liquid bath, such as an oil bath. The ageing treatment typically takes from at least 1 minute to 24 hours, but in most embodiments does not exceed 12 hours.

EXAMPLES

A series of experiments were undertaken to test the baseline properties (strength including yield strength) of the described alloy embodiments as a dilute magnesium alloy sheet product, and to establish the strengthening properties of the method of the present invention on the formed dilute magnesium alloy sheet products.

A number of alloy compositions and sheets formed therefrom according to the present invention were formed and tested in these experiments. Table 1 summarises the composition of each of the tested dilute magnesium alloy sheet compositions.

A sheet of each of the alloy compositions were produced using the above described method. In these experiments, respective elements were mixed and melted in a high frequency induction melting furnace using a mild steel crucible at approximately 760° C. under an argon atmosphere. The alloy melt was cast into a steel mould that was pre-heated to about 200° C. The homogenisation treatments were done in the temperature ranging from 300 to 420° C., depending upon alloy composition. The homogenised ingots were machined into strips of 5 mm thickness and then hot rolled in the temperature range of 350 to 500° C. The total reduction was about 85% with the thickness reduction per pass being about 20%. After each rolling pass, the sheets were reheated at a temperature in the range of 350 to 500° C. for about 10 minutes prior to subsequent rolling. Optionally, a cold rolling was adopted as a final rolling. After the final rolling, the sheets (with or without cold rolling) were given an annealing treatment to remove accumulated strains through static recrystallization.

Following annealing, each sample underwent strengthening treatment according to the method of the present invention involving plastic deformation (in a pre-deformation step) followed by an ageing treatment. The pre-deformation step was undertaken by either tensile stretching at room temperature or by cold rolling. The ageing treatment was undertaken in oil bathes, where the ageing temperature was set between 80° C. to 250° C., and the ageing time preferably did not to exceed 12 hours.

The strain-induced ageing response of both the originally formed dilute magnesium alloy sheets and the strengthening treated sheets (i.e. aged pre-deformed sheets) was measured using an Instron 4505 tensile test with a strain rate of $10^{-3}$/s. A thickness of each tensile sample was about 0.7 to 1 mm and gage length was about 10 mm.

Three sets of samples were produced for testing:

Annealed (designated O), i.e. the dilute magnesium alloy sheets as originally formed following annealing treatment;

annealed and aged (designated T6), i.e. the dilute magnesium alloy sheets as originally formed following annealing treatment and then treated using ageing treatment. No pre-deformation step is undertaken for this sample. These samples were produced for comparison purposes to quantify the effect of ageing the dilute magnesium alloy sheets in isolation to pre-deformation; and annealed and strain-aged alloy sheets (designated T8)—the dilute magnesium alloy sheets following pre-deformation step and ageing treatment according to the present invention.

In order to facilitate expressions in the following examples, annealed, annealed and aged, and annealed and strain-aged alloy sheets are represented by O (annealed), T6 (annealed and aged), and T8 (annealed and strain-aged alloy sheets), respectively.

Detailed alloy compositions, thermomechanical processing parameters for the corresponding alloy sheets, and ageing and strain ageing process are given in Tables 1 and 2, respectively:

TABLE 1

Designations and processing parameters for different alloy compositions.

| Sheet No. | Composition (wt %) | Hot Rolling: Rolling Temp. (° C.) | Hot Rolling: Total Reduction (%) | Hot Rolling: Pass | Hot Rolling: Initial Thickness (mm) | Hot Rolling: Final Thickness (mm) | Cold Rolling: Reduction (%) | Cold Rolling: Pass | Cold Rolling: Final Thickness (mm) |
|---|---|---|---|---|---|---|---|---|---|
| 1 | Mg-1Zn-0.4Gd-0.2Ca | 450 | 80 | 8 | 5 | 1 | — | — | — |
| 2 | Mg-1.3Gd | 450 | 80 | 8 | 5 | 1 | — | — | — |
| 3 | Mg-1Zn-0.5Ca | 350 | 80 | 8 | 5 | 1 | 10 | 1 | 0.9 |
| 4 | Mg-2Zn-0.4Gd-0.2Ca | 450 | 80 | 8 | 5 | 1 | — | — | — |
| 5 | Mg-2Zn-0.5Ca | 350 | 80 | 8 | 5 | 1 | 10 | 1 | 0.9 |
| 6 | Mg-0.8Ca-0.4Zn-0.1Sr-0.5Zr | 500 | 80 | 8 | 5 | 1 | — | — | — |
| 7 | Mg-0.8Ca-0.4Zn-0.4Gd-0.5Zr | 500 | 80 | 8 | 5 | 1 | — | — | — |
| 8 | Mg-0.8Ca-0.4Zn-0.1Sr-0.4Gd-0.5Zr | 500 | 80 | 8 | 5 | 1 | — | — | — |
| 9 | Mg-2Zn-0.5Ca-0.5Zr | 350 | 80 | 8 | 5 | 1 | 10 | 1 | 0.9 |
| 10 | Mg-2Zn-0.4Gd-0.2Ca | 350 | 80 | 8 | 5 | 1 | 10 | 1 | 0.9 |
| 11 | Mg-1Zn-0.5Ca | 400 | 80 | 8 | 5 | 1 | 20 | 1 | 0.8 |

TABLE 2

Summary of the annealing, ageing and plastic deformation under different conditions.

| Sheet No. | O Annealing Condition | T6 Annealing Condition | T6 Ageing Condition | T8 Annealing Condition | T8 Plastic Deformation (%) | T8 Ageing Condition |
|---|---|---|---|---|---|---|
| 1 | 400° C. 30 min. | 400° C. 30 min. | 200° C. 30 min. | 400° C. 30 min. | 1.5 | 200° C. 30 min. |
| 2 | 400° C. 30 min. | 400° C. 30 min. | 200° C. 60 min. | 400° C. 30 min. | 1.5 | 200° C. 60 min. |
| 3 | 400° C. 10 min. | 400° C. 10 min. | 200° C. 30 min. | 400° C. 10 min. | 1.5 | 200° C. 30 min. |
| 4 | 400° C. 30 min. | 400° C. 30 min. | 200° C. 30 min. | 400° C. 30 min. | 1.5 | 200° C. 30 min. |
| 5 | 400° C. 10 min. | 400° C. 10 min. | 200° C. 30 min. | 400° C. 10 min. | 1.5 | 200° C. 30 min. |
| 6 | 400° C. 30 min. | 400° C. 30 min. | 200° C. 30 min. | 400° C. 30 min. | 2.5 | 200° C. 30 min. |
| 7 | 400° C. 30 min. | 400° C. 30 min. | 200° C. 30 min. | 400° C. 30 min. | 2.5 | 200° C. 30 min. |
| 8 | 400° C. 30 min. | 400° C. 30 min. | 200° C. 30 min. | 400° C. 30 min. | 2.5 | 200° C. 30 min. |
| 9 | 400° C. 10 min. | — | — | 400° C. 10 min. | 1.5 | 200° C. 30 min. |

Example 1: Strain-Induced Age Strengthening of Mg—(Zn)—RE and Mg—Zn—(RE)-Ca—Zr Based Alloy Sheets Sheets 1 to 8 underwent the O, T6 and T8 treatments, and Sheet 9 underwent the O and T8 treatments shown in Table 2. The results of these treatments are summarised in Table 3.

Figure 2:
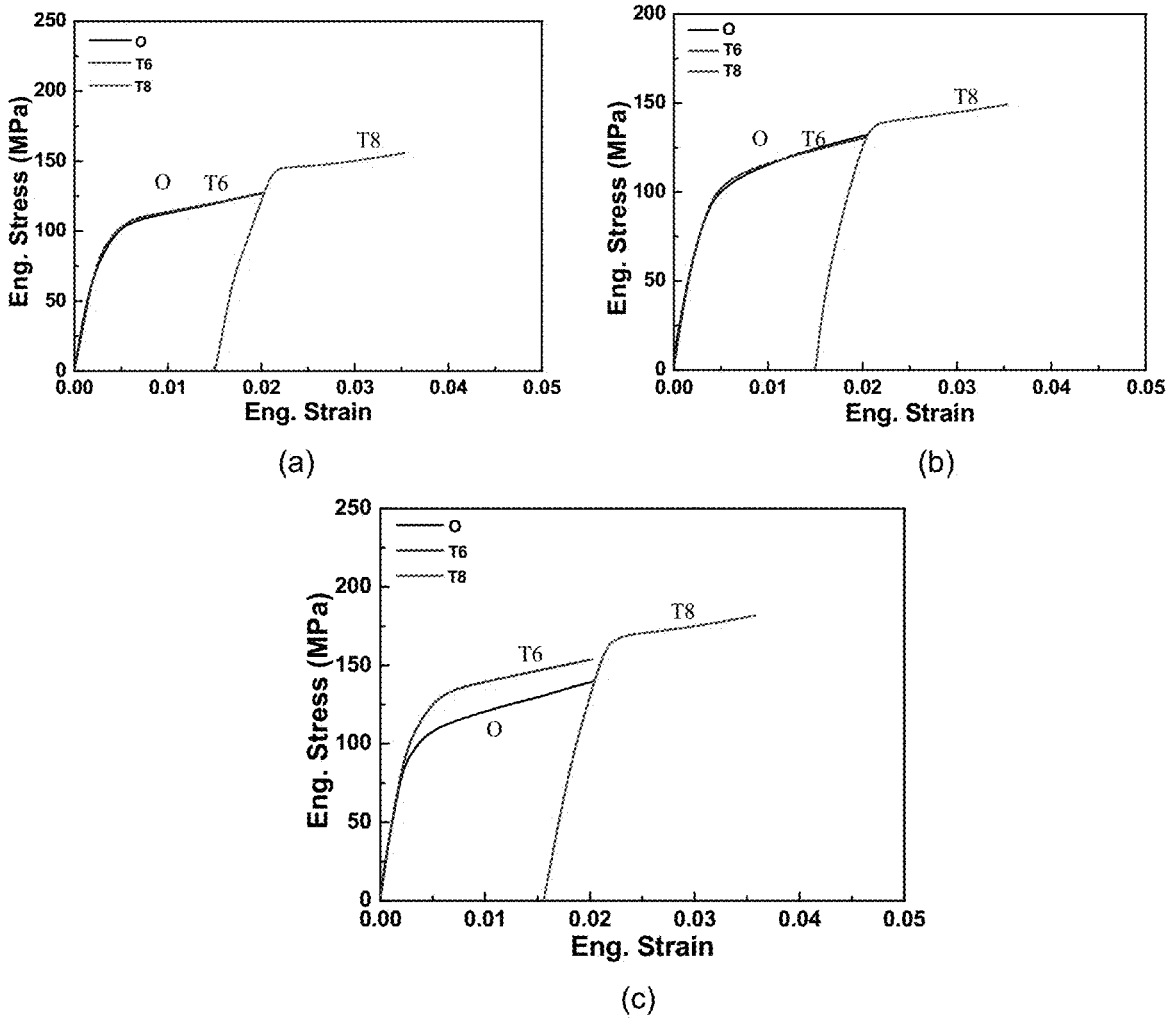
FIG. 2 provides tensile curves of as-annealed, T6 (200° C., 30 min. ageing) and T8 (1.5% tensile deformation followed by 200° C., 30 min. ageing) treated (a) Mg-1Zn-0.4Gd-0.2Ca, (b) Mg-1.3Gd, and (c) Mg-1Zn-0.5Ca alloy sheets.

Furthermore, the tensile curves of as-annealed, T6 (200° C., 30 min. ageing) and T8 (1.5% tensile deformation followed by 200° C., 30 min. ageing) treated (a) Mg-1Zn-0.4Gd-0.2Ca (sheet 1), (b) Mg-1.3Gd (sheet 2), and (c) Mg-1Zn-0.5Ca (sheet 3) alloy sheets are provided in FIG. 2.

TABLE 3

The yield strength, tensile stress at 1.5% or 2.5 plastic strain, and increment of strength under the ageing or strain ageing treatments.

| Sheet No. | Condition | YS (MPa) | TS (MPa) | Strength Increment: Direct Ageing MPa | Direct Ageing % | Strain Ageing MPa | Strain Ageing % |
|---|---|---|---|---|---|---|---|
| 1 | O | 90 | 127 | 1 | 1 | 55 | 61 |
| | T6 | 91 | 127 | | | | |
| | T8 | 145 | 156 | | | | |
| 2 | O | 101 | 133 | 2 | 2 | 38 | 38 |
| | T6 | 103 | 132 | | | | |
| | T8 | 139 | 149 | | | | |
| 3 | O | 106 | 139 | 19 | 18 | 70 | 66 |
| | T6 | 125 | 154 | | | | |
| | T8 | 176 | 185 | | | | |

TABLE 3-continued

The yield strength, tensile stress at 1.5% or 2.5 plastic strain, and increment of strength under the ageing or strain ageing treatments.

| Sheet | | YS | TS | Strength Increment | | | |
|---|---|---|---|---|---|---|---|
| | | | | Direct Ageing | | Strain Ageing | |
| No. | Condition | (MPa) | (MPa) | MPa | % | MPa | % |
| 4 | O | 91 | 125 | 23 | 25 | 67 | 74 |
| | T6 | 114 | 153 | | | | |
| | T8 | 158 | 168 | | | | |
| 5 | O | 106 | 136 | 34 | 32 | 90 | 85 |
| | T6 | 140 | 177 | | | | |
| | T8 | 196 | 203 | | | | |
| 6 | O | 132 | 161 | 42 | 32 | 88 | 66 |
| | T6 | 174 | 207 | | | | |
| | T8 | 220 | 227 | | | | |
| 7 | O | 129 | 163 | 37 | 29 | 80 | 62 |
| | T6 | 166 | 191 | | | | |
| | T8 | 209 | 216 | | | | |
| 8 | O | 137 | 168 | 31 | 23 | 76 | 55 |
| | T6 | 168 | 199 | | | | |
| | T8 | 213 | 217 | | | | |
| 9 | O | 182 | 187 | — | — | 52 | 29 |
| | T8 | 234 | 236 | | | | |

NOTE:
Strength Increment by Direct Ageing (MPa) = $T6_{YS}$-$O_{YS}$
Strength Increment by Direct Ageing (%) = 100*($T6_{YS}$-$O_{YS}$)/$O_{Ys}$
Strength Increment by Strain Ageing (MPa) = $T8_{YS}$-$O_{YS}$
Strength Increment by Strain Ageing (%) = 100* ($T8_{YS}$-$O_{YS}$)/$O_{YS}$ From these results it can be seen that for the Mg—Zn-RE based alloy sheets represented by the Mg-1Zn-0.4Gd-0.2Ca (sheet 1) sample, the ageing treatment (T6) did not bring any increase in strength. However, induction of 1.5% tensile plastic deformation at room temperature followed by ageing treatment (T8) could lead to increase in the strength of 55 MPa, and the increment was about 61%. However, for Mg-RE binary alloy sheets represented by the Mg-1.3Gd (sheet 2) alloy, the T6 treatment did not deliver any improvement in strength, and the T8 treatment also caused an increase in strength about 38 MPa (38% increment). When calcium completely replaced rare earth element, i.e. Mg-1Zn-0.5Ca (sheet 3), the T6 treatment did lead to the increment of the yield strength from 106 MPa to 125 MPa. On the other hand, the T8 treatment that caused substantial increase in the strength increment of 70 MPa increased yield strength from 106 MPa to 176 MPa. This strength increment is far greater than the strength increment produced by the T6 treatment.

Overall, it can be concluded that the inventive T8 treatment (deformation plus ageing) delivered an appreciable increase in strength with addition of small amounts of zinc, calcium and rare earth element gadolinium, regardless of whether the T6 treatment (ageing alone) could lead to an age hardening phenomenon or not.

Example 2: Effects of Zinc Content on the Strain-Induced Age Strengthening Phenomenon The results of Mg-2Zn-0.4Gd-0.2Ca (sheet 4), and (b) Mg-2Zn-0.5Ca (sheet 5) alloy sheets shown in Table 3 indicate that zinc content of the studied alloys has a crucial impact on the extent of strain-induced age strengthening.

When the zinc content was increased from 1% to 2% and the concentration of gadolinium and calcium was maintained at 0.4% and 0.2% respectively, the strength increment by the T8 treatment raised from 55 MPa to 67 MPa. Certainly, even if the T6 treatment also caused an increase in the strength of 23 MPa when the zinc concentration was increased to 2%.

Furthermore, when the zinc content was increased from 1% to 2% and the concentration of calcium was maintained at 0.5%, the T8 treatment led a substantial increase in strength of 90 MPa, which is 85% increment in comparison with the yield strength of annealed state.

Figure 3:
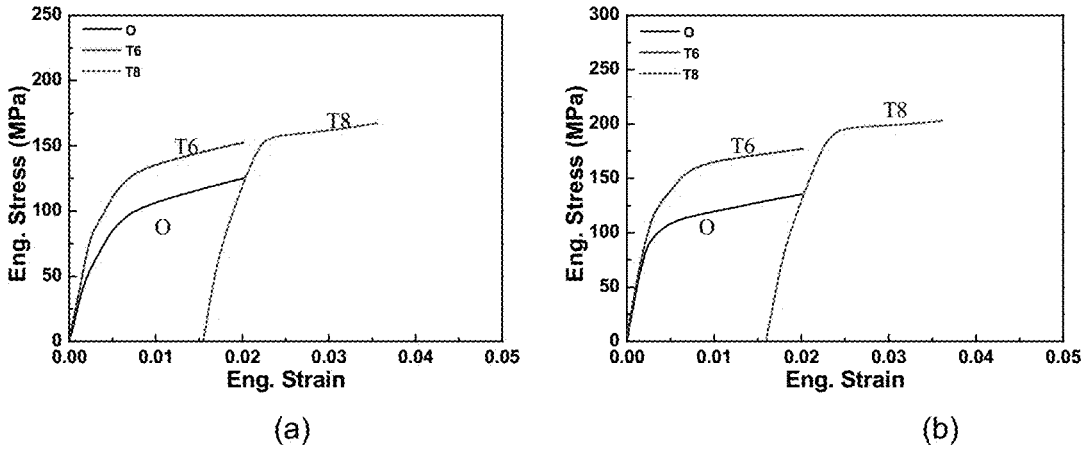
FIG. 3 provides tensile curves of as-annealed, T6 (200° C., 30 min. ageing) and T8 (1.5% tensile deformation followed by 200° C., 30 min. ageing) treated (a) Mg-2Zn-0.4Gd-0.2Ca, and (b) Mg-2Zn-0.5Ca alloy sheets.

The above is also demonstrated in FIG. 3 which provides tensile curves of as-annealed, T6 (200° C., 30 min. ageing) and T8 (1.5% tensile deformation followed by 200° C., 30 min. ageing) treated (a) Mg-2Zn-0.4Gd-0.2Ca (sheet 4), and (b) Mg-2Zn-0.5Ca (sheet 5) alloy sheets.

Figure 4:
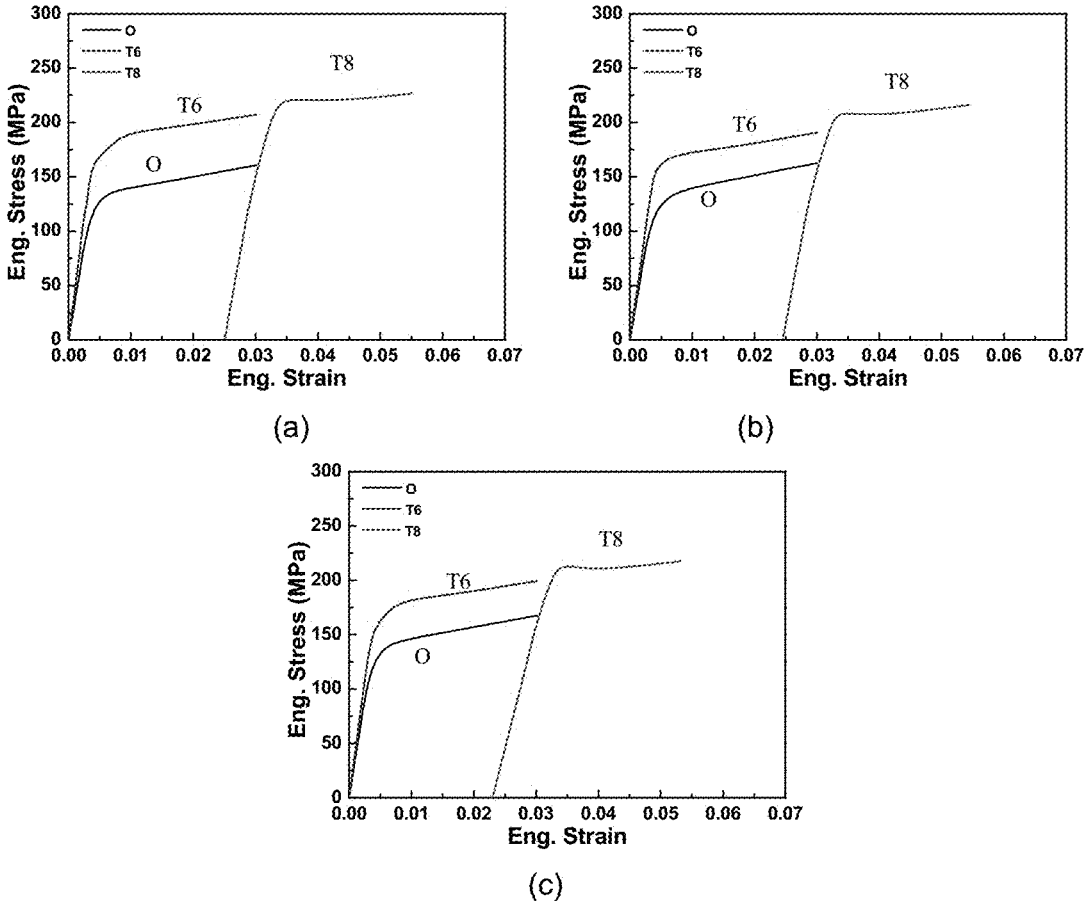
FIG. 4 provides tensile curves of as-annealed, T6 (200° C., 30 min. ageing) and T8 (2.5% tensile deformation followed by 200° C., 30 min. ageing) treated (a) Mg-0.8Ca-0.4Zn-0.1Sr-0.5Zr, (b) Mg-0.8Ca-0.4Zn-0.4Gd-0.5Zr, and (c) Mg-0.8Ca-0.4Zn-0.1Sr-0.4Gd-0.5Zr alloy sheets.

Example 3: Strain-Induced Age Strengthening Response of Mg—Ca—Zn—(Zr) Based Alloy Sheets The results of Mg-0.8Ca-0.4Zn-0.1Sr-0.5Zr (sheet 6), Mg-0.8Ca-0.4Zn-0.4Gd-0.5Zr (sheet 7), and Mg-0.8Ca-0.4Zn-0.1Sr-0.4Gd-0.5Zr (sheet 8) alloys alloy sheets shown in Table 3 provide the strain-induced age strengthening response of Mg—Ca—Zn—(Zr) based alloy sheets. FIG. 4 also shows the strain-induced age strengthening response of the Mg—Ca—Zn—(Zr) alloy system.

The results demonstrate that the T6 treatment caused a strength increment of 42 MPa, 37 MPa and 31 MPa for the Mg-0.8Ca-0.4Zn-0.1Sr-0.5Zr (sheet 6), Mg-0.8Ca-0.4Zn-0.4Gd-0.5Zr (sheet 7), and Mg-0.8Ca-0.4Zn-0.1Sr-0.4Gd-0.5Zr (sheet 8) alloys, respectively. On the other hand, the T8 treatment resulted in much higher strength increment of about 88 MPa, 80 MPa and 76 MPa, respectively.

Example 4: Strain-Induced Age Strengthening Response of Mg—Zn—Ca—Zr Based Alloy Sheets The strain-induced age strengthening response of Mg—Zn—Ca—Zr based alloy sheets were studied through the results for Mg-2Zn-0.5Ca-0.5Zr (sheet 9) alloy sheet (Table 3).

Figure 5:
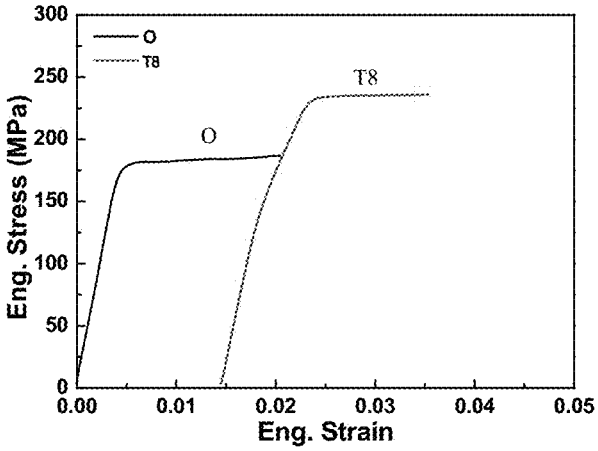
FIG. 5 provides tensile curves of as-annealed and T8 (1.5% tensile deformation followed by 200° C., 30 min. ageing) treated Mg-2Zn-0.5Ca-0.5Zr alloy sheet.

FIG. 5 provides tensile curves of as-annealed and T8 (1.5% tensile deformation followed by 200° C., 30 min. ageing) treated Mg-2Zn-0.5Ca-0.5Zr (sheet 9) alloy sheet. These curves demonstrate that the 0.5% Zr addition to the Mg-2Zn-0.5Ca could effectively refine grain size, thereby the strength of annealed state increased accordingly. The yield strength of the as-annealed Mg-2Zn-0.5Ca-0.5Zr was about 182 MPa, and the yield strength of the T8 treated one reached about 234 MPa which is the highest of all the reported dilute Mg—Zn based sheet compositions.

Example 5: Effects of Annealing Parameters on Strain-Induced Age Strengthening Response The Mg-2Zn-0.4Gd-0.2Ca alloy sheet (sheet 10) was used to investigate the effects of annealing parameters on the strain-ageing properties. The following annealing parameters were investigated:

350° C. for 10 min.;

400° C. for 10 min.;

450° C. for 5 min.; and

500° C. for 3 min.

The results of these experiments are provided in Table 4:

TABLE 4

Yield strength of Mg-2Zn-0.5Gd-0.2Ca alloy sheet undergone different annealing process, tensile strength at 1.5% plastic strain, and increment of strength caused by the strain ageing treatment.

| | O | | | T8 | | | | | Strength Increment by Strain Ageing | |
|---|---|---|---|---|---|---|---|---|---|---|
| Sheet No. | Annealing Condition | YS (MPa) | TS (MPa) | Annealing Condition | Plastic Deformation (%) | Ageing Condition | YS (MPa) | TS (MPa) | MPa | % |
| 10 | 350° C. 10 min. | 163 | 173 | 350° C. 10 min. | 1.5 | 200° C. 30 min. | 196 | 199 | 33 | 20 |
| | 400° C. 10 min. | 102 | 138 | 400° C. 10 min. | 1.5 | 200° C. 30 min. | 181 | 191 | 79 | 77 |
| | 450° C. 5 min. | 99 | 136 | 450° C. 5 min. | 1.5 | 200° C. 30 min. | 179 | 188 | 80 | 81 |
| | 500° C. 3 min. | 92 | 132 | 500° C. 3 min. | 1.5 | 200° C. 30 min. | 174 | 183 | 82 | 89 |

Figure 6:
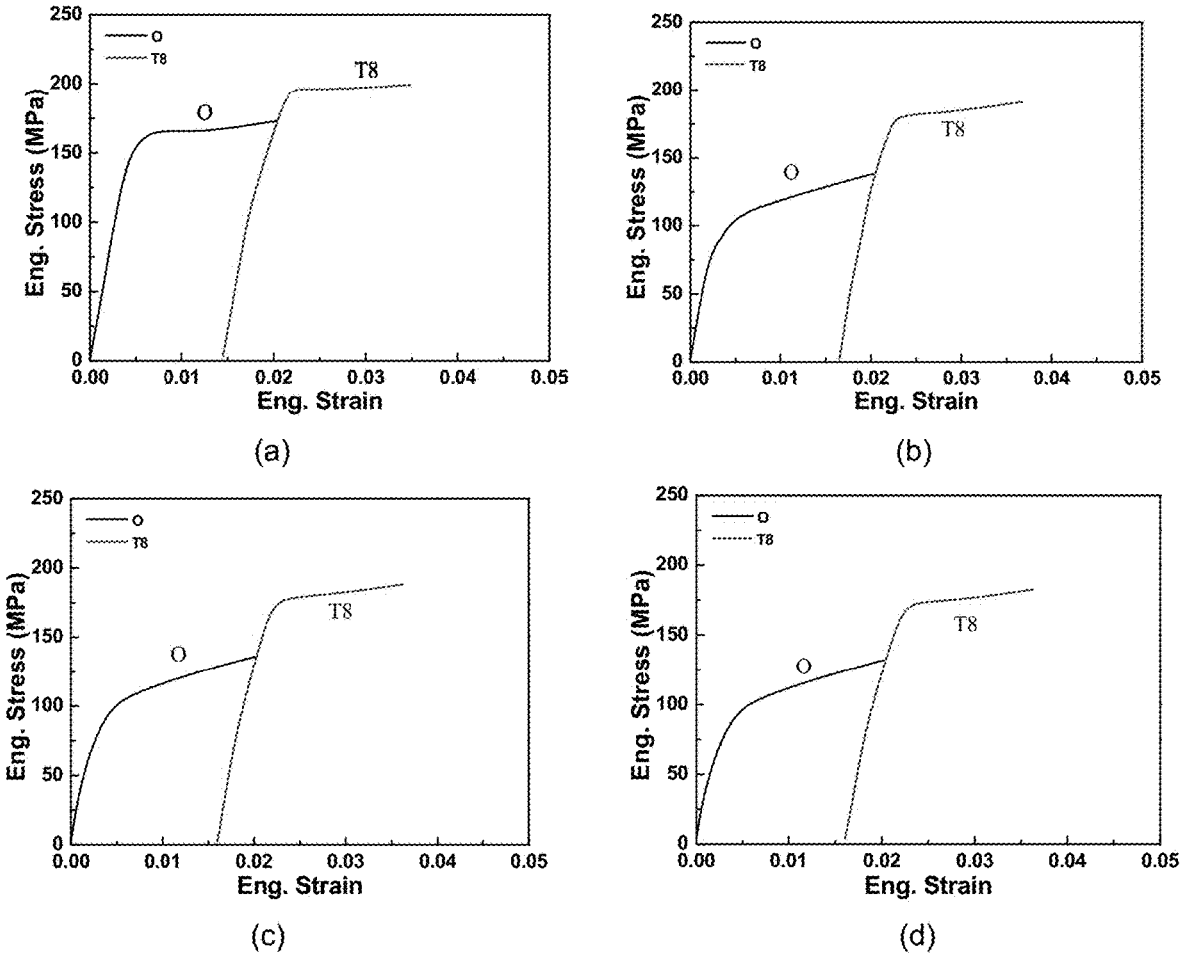
FIG. 6 provides tensile curves of as-annealed and T8 (1.5% tensile deformation followed by 200° C., 30 min. ageing) treated Mg-2Zn-0.4Gd-0.2Ca under different annealing conditions (a) 350° C., 10 min., (b) 400° C., 10 min., (c) 450° C., 5 min. and (d) 500° C., 3 min.

The results indicated that a low temperature annealing, for instance the 350° C. annealing delivered the highest yield strength (163 MPa), but this condition produced the low strength increment of 33 MPa by the T8 treatment, as shown in FIG. 6. With increasing the annealing temperature, the yield strength of the as-annealed sheets was decreased gradually from 102 MPa at 400° C. for 10 min. to 92 MPa at 500° C. for 3 min., whereas the strength increment by T8 treatment appeared to be high and maintained stable at around 79 to 82 MPa.

Example 6: Effects of Ageing Parameters on Strain-Induced Age Strengthening Response The effects of ageing parameters on strain-induced age strengthening response of a Mg-1Zn-0.5Ca (sheet 3) alloy sheet in the T8 treatment was investigated by varying the ageing parameters (time and temperature), whilst maintaining the same pre-deformation at 1.5% plastic strain and annealing conditions (400° C. 10 min.) for each sample. The various experimental conditions and results of these experiments are provided in Table 5.

TABLE 5

Yield strength of Mg-1Zn-0.5Ca alloy sheet (sheet 3) undergone different ageing process, tensile strength at 1.5% plastic strain, and increment of strength caused by the strain ageing treatment.

| | O | | | T8 | | | | | Strength Increment by Strain Ageing | |
|---|---|---|---|---|---|---|---|---|---|---|
| Sheet No. | Annealing Condition | YS (MPa) | TS (MPa) | Annealing Condition | Plastic Deformation (%) | Ageing Condition | YS (MPa) | TS (MPa) | MPa | % |
| 3 | 400° C. 10 min. | 105 | 140 | 400° C. 10 min. | 1.5 | 150° C. 12 h. | 173 | 180 | 68 | 65 |
| | | 103 | 139 | | 1.5 | 150° C. 24 h. | 173 | 185 | 70 | 68 |
| | | 105 | 136 | | 1.5 | 200° C. 30 min. | 174 | 184 | 69 | 66 |
| | | 103 | 137 | | 1.5 | 200° C. 60 min. | 168 | 179 | 65 | 63 |
| | | 106 | 141 | | 1.5 | 200° C. 120 min. | 172 | 185 | 66 | 62 |

Figure 7:
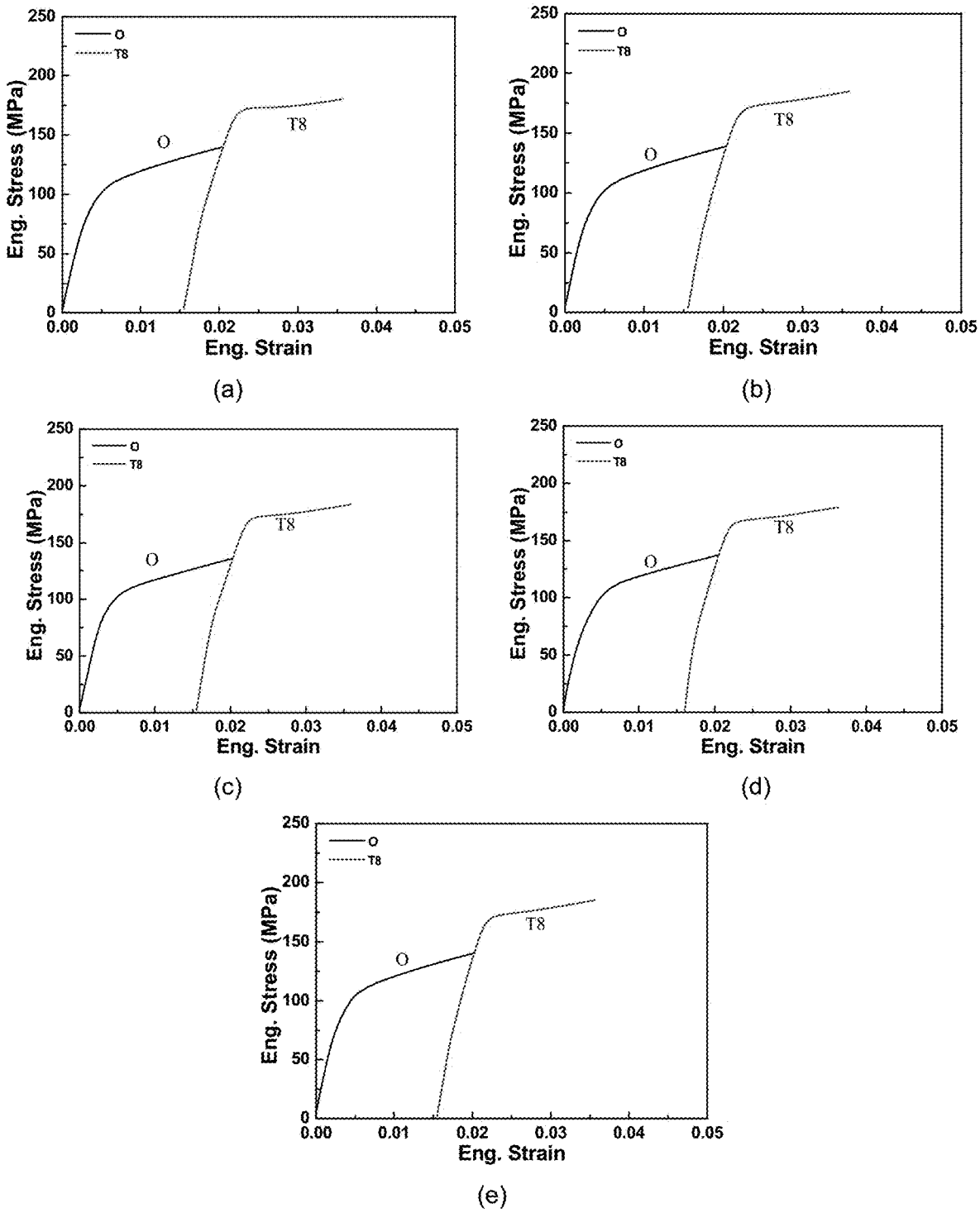
FIG. 7 provides tensile curves of as-annealed and T8 treated Mg-1Zn-0.5Ca under different ageing conditions (a) 150° C., 12 h., (b) 150° C., 24 h., (c) 200° C., 30 min., (d) 200° C., 60 min. and (d) 200° C., 120 min.

The results indicate that when the Mg-1Zn-0.5Ca alloy sheet aged at 150° C., the strength increment remained similar value and maintained stable at around 68 to 70 MPa regardless of different ageing time, as shown in FIG. 7. When the Mg-1Zn-0.5Ca alloy sheet aged at 200° C., it only took 30 minutes to reach the strength increment of 69 MPa. With prolonging the ageing time, the strength increment of the alloy sheet was decreased slightly. When the strain-induced ageing time reached about 120 Min., the strength increment was decreased to 66 MPa.

Example 7: Effects Cold Rolling as a Means of Pre-Deformation on Strain-Induced Age Strengthening Response The effectiveness of cold rolling on the strain-induced strengthening response for the T8 treatment was investigated by testing the Mg-1Zn-0.5Ca sheet sample (sheet 11) under different cold rolling reduction, i.e., 5%, 8% and 10%, followed by ageing treatment and tensile testing.

Figure 8:
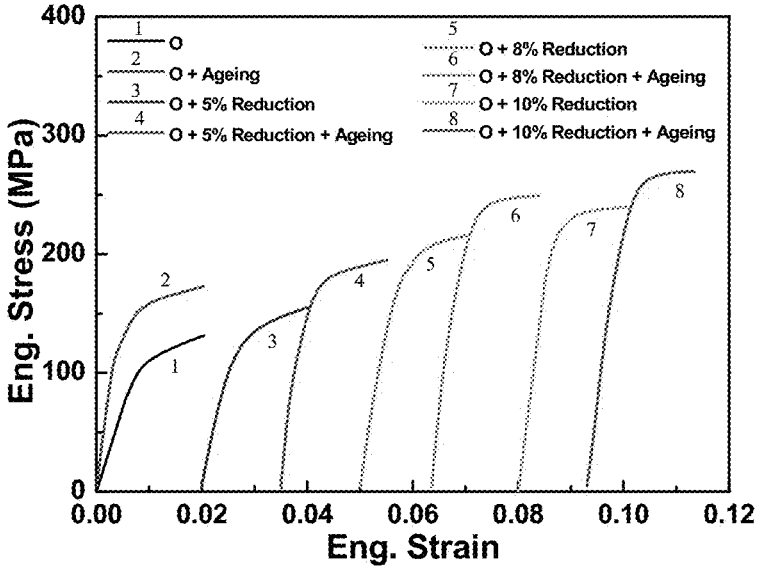
FIG. 8 provides tensile curves of the Mg-1Zn-0.5Ca alloy under the T8 treatment. Pre-deformation was introduced by cold rolling under different reductions of 5%, 8% and 10%.

The test results are given in FIG. 8 and Table 6.

TABLE 6

Yield strength of Mg-1Zn-0.5Ca alloy sheet undergone different reduction of cold rolling, tensile strength at 1.5% plastic strain, and increment of strength caused by the ageing and strain ageing treatments.

| Sheet No. | Processing Condition | Processing Condition | YS (MPa) | TS (MPa) | Strength Increment by Ageing (1) or Strain Ageing (2) MPa | % |
|---|---|---|---|---|---|---|
| 11 | O | 400° C. 10 min. | 108 | 132 | — | — |
| | T6 | 400° C. 10 min. + 200° C. 30 min. | 125 | 173 | 17 (1) | 16 (1) |
| | T8 | 400° C. 10 min. + 5% Reduction + 200° C. 30 min. | 157 | 195 | 49 (2) | 45 (2) |
| | | 400° C. 10 min. + 8% Reduction + 200° C. 30 min | 211 | 249 | 103 (2) | 95 (2) |
| | | 400° C. 10 min. + 10% Reduction + 200° C. 30 min | 247 | 270 | 139 (2) | 129 (2) |

These results indicate that as the reduction of cold rolling was increased from 5% to 10%, the strength increment of the alloy sheet processed by the T8 treatment changed from 49 MPa to 139 MPa.

CONCLUSION

A large number of experimental results show that the strength of Mg—(Zn)—RE, Mg—Zn—(RE)-Ca—(Zr) and Mg—Ca—Zn—(Zr) based dilute sheet alloys have been significantly increased under the strain ageing treatment (T8 treatment in the preceding examples). Even if a part of alloy sheets could be age hardened (for example the T6 treatment in the examples), their strength increment resulting from age hardening alone is far less than that caused by the strain-induced strengthening treatment of the present invention.

Thus, compared to prior Magnesium alloy strengthening methods, the method of the present invention provides the following FIVE advantageous differences:

1. Dilute alloy addition—the present invention strengthens dilute magnesium alloy sheets, i.e. sheets having <3 wt % alloying elements. This has not been previously reported. Such dilute-alloyed Mg sheets are not expected to have plastic-strain-induced age hardening phenomenon;
2. Significant improvement in strength—the magnitude of strengthening in the above examples is as large as 129%, which is unexpected especially in such dilute-alloyed sheet;
3. Small plastic strain—It is unexpected that such small amounts of tensile strain, for example as low as 2% tensile plastic strain in the above examples, can also create a significant improvement in strength;
4. Different mechanisms of hardening—as detailed above the mechanism of strengthening is more likely to be the effective pinning of mobile basal dislocation by GP zones and solute atoms, as opposed to precipitation hardening reported in the prior art; and
5. Easy processing—The alloy sheets covered by the present invention can be easily produced by hot-rolling from as-cast ingot. Mg alloys with strong age hardening effect are generally very difficult to be processed, such as the alloys mentioned in the prior arts. They can only be hot-extruded, or rolled with a very small thickness reduction, and thus extremely difficult to be fabricated into rolling sheets.

The inventors consider that the above features make the inventive alloy sheets particularly suitable a range of existing manufacturing technologies, including extrusion, forging and twin-roll casting, and in particular vehicle or automotive applications.

Those skilled in the art will appreciate that the invention described herein is susceptible to variations and modifications other than those specifically described. It is understood that the invention includes all such variations and modifications which fall within the spirit and scope of the present invention.

Where the terms "comprise", "comprises", "comprised" or "comprising" are used in this specification (including the claims) they are to be interpreted as specifying the presence of the stated features, integers, steps or components, but not precluding the presence of one or more other feature, integer, step, component or group thereof.

Future patent applications may be filed in Australia or overseas on the basis of or claiming priority from the present application. It is to be understood that the following provisional claims are provided by way of example only, and are not intended to limit the scope of what may be claimed in any such future application. Features may be added to or omitted from the provisional claims at a later date so as to further define or re-define the invention or inventions.

What is claimed is:

1. A method of strengthening a dilute magnesium alloy sheet comprising:

providing a dilute magnesium alloy sheet comprising a magnesium alloy selected from the group consisting of Mg-1Zn-0.4Gd-0.2Ca, Mg-1Zn-0.5Ca, Mg-2Zn-0.4Gd-0.2Ca, and Mg-2Zn-0.5Ca;

subjecting the dilute magnesium alloy sheet to plastic deformation, in which the tensile plastic strain should exceed 0.5%, but less than 8% to form a pre-deformed magnesium alloy sheets; and subjecting the pre-deformed magnesium alloy sheets to an ageing treatment in a temperature range of 80 to 250° C. for at least 1 minute, thereby forming a strengthened magnesium alloy sheet.

2. The method of claim 1, wherein tensile plastic strain is controlled in the range of 0.5 to 6%.

3. The method of claim 1, wherein plastic deformation is achieved by at least one of tensile stretching or cold rolling.

4. The method of claim 3, wherein said tensile stretching is conducted at room temperature.

5. The method of claim 3, wherein the reduction in thickness of the magnesium alloy sheet resulting from cold rolling does not exceed 10%.

6. The method of claim 1, wherein the temperature range of the ageing treatment is between 100 and 250° C.

7. The method of claim 1, wherein the ageing treatment is conducted in air or oil.

8. The method of claim 1, wherein the ageing treatment is no more than 24 hours.

9. The method of claim 1, wherein the ageing treatment is at least 1 minute.

10. The method of claim 1, wherein the ageing treatment is between 5 minutes and 12 hours.

11. The method of claim 1, wherein the strength increase of the strengthened magnesium alloy sheet relative to the dilute magnesium alloy sheet is at least 10%.

12. The method of claim 1, wherein the strength increase of the strengthened magnesium alloy sheet relative to the dilute magnesium alloy sheet is between 20% and 100%.

13. The method of claim 1, wherein the strength increase of the strengthened magnesium alloy sheet relative to the dilute magnesium alloy sheet is at least 20 MPa.

14. The method of claim 1, wherein the strength increase of the strengthened magnesium alloy sheet relative to the dilute magnesium alloy sheet is between 33 MPa and 139 MPa.

15. The method of claim 1, wherein the step of forming the dilute magnesium alloy sheet comprises:

providing a magnesium alloy melt from the magnesium-based alloy;

casting said magnesium alloy melt into a slab or a strip according to a predetermined thickness;

homogenising or preheating said cast slab or strip;

successively hot rolling said homogenised or preheated slab or strip at a suitable temperature to reduce said thickness of said homogenised slab or strip to produce an alloy sheet product of a predetermined thickness; and annealing said alloy sheet product at a suitable temperature for a period of time.

16. A magnesium alloy sheet formed from a method according to claim 1.

17. The method of claim 1, wherein tensile plastic strain is controlled in the range of 1 to 4%.

18. The method of claim 1, wherein the temperature range of the ageing treatment is between 100 and 200° C.

19. The method of claim 1, wherein the ageing treatment is conducted in oil baths.

20. The method of claim 1, wherein the ageing treatment is no more than 12 hours.

21. The method of claim 1, wherein the strength increase of the strengthened magnesium alloy sheet relative to the dilute magnesium alloy sheet is at least 20%.

22. The method of claim 1, wherein the strength increase of the strengthened magnesium alloy sheet relative to the dilute magnesium alloy sheet is at least 33 MPa.

* * * * *